US006526698B2

(12) United States Patent
Park et al.

(10) Patent No.: US 6,526,698 B2
(45) Date of Patent: Mar. 4, 2003

(54) DOOR GASKET MOUNTING STRUCTURE FOR A REFRIGERATOR

(75) Inventors: Jong-Woon Park, Changwon (KR); Han-Hyo Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/876,036

(22) Filed: Jun. 8, 2001

(65) Prior Publication Data

US 2002/0184828 A1 Dec. 12, 2002

(51) Int. Cl.[7] ..... E06B 7/16
(52) U.S. Cl. ..... 49/489.1
(58) Field of Search ..... 49/489.1, 475.1, 49/498.1, 492.1

(56) References Cited

U.S. PATENT DOCUMENTS 3,226,367 A * 12/1965 Monti ..... 49/492.1
3,289,352 A * 12/1966 Heilweeil et al. ..... 49/492.1
3,378,957 A * 4/1968 Frehse ..... 49/492.1
4,617,759 A * 10/1986 Pasqualini et al. ..... 49/492.1
6,227,634 B1 * 5/2001 Cittadini et al. ..... 49/498.1

* cited by examiner

*Primary Examiner*—Jerry Redman
(74) *Attorney, Agent, or Firm*—Fleshner & Kim, LLP

(57) ABSTRACT

A door gasket mounting structure for a refrigerator is disclosed. The door gasket mounting structure comprises an engagement groove and a laterally projected portion. The engagement groove accommodates the engagement portion of a door gasket, and is formed along the peripheral portion of a door liner. The laterally projected portion holds the engagement portion of the door gasket while the door gasket has been inserted into the engagement groove, and is formed on one of either side of an entrance portion of the engagement groove.

3 Claims, 2 Drawing Sheets

DOOR GASKET MOUNTING STRUCTURE FOR A REFRIGERATOR

BACKGROUND OF THE INVENTION

1. Field of the Invention

The present invention relates, in general, to a refrigerator and, more particularly, to a door gasket mounting structure for a refrigerator that allows the door liner of the refrigerator to be easily formed and facilitates the insertion of the door gasket into the mounting structure.

2. Description of the Prior Art

As well known to those skilled in the art, the interior of a refrigerator is divided into a freezer compartment and a fresh food compartment by means of a barrier. Such freezer and fresh food compartments are selectively opened and closed by means of compartment doors. Gaskets made of soft synthetic resin or rubber are respectively mounted along the inner peripheral portions of the compartment doors. Such gaskets are constructed to prevent cold air in the compartments from leaking out of the compartments while the compartment doors are closed.

FIG. 1 is a cross section showing a state where a general gasket is mounted to a conventional door gasket mounting structure formed on the inside surface of a refrigerator door. As illustrated in the drawing, the general gasket 10 comprises a magnet holding compartment 12, three vacant compartments 14*a*, 14*b* and 14*c* and an engagement projection 16.

The magnet holding compartment 12 holds a magnet (not shown) in its interior and is capable of adhering to the front portion of the main body of the refrigerator. The vacant compartments 14*a*, 14*b* and 14*c* are positioned between the interior and exterior of the refrigerator while the magnet holding compartment is brought into contact with the front portion of the main body of the refrigerator. The vacant compartments 14*a*, 14*b* and 14*c* function to insulate the interior of the refrigerator from the exterior of the refrigerator.

The engagement projection 16 is formed on the outer surfaces of the vacant compartments 14*b* and 14*c*, and is engaged with the engagement groove (will be described) of the door liner (will be described). The engagement projection 16 has an anchor portion 16a that is rearward projected at a certain inclined angle from its outer end. The engagement projection 16 serves to prevent the gasket 10 inserted into the engagement groove from being removed.

The door liner 20 forming the inner surface of the door may be made of synthetic resin such as Acrylonitrile Butadiene Styrene resin (ABS). The door liner 20 has a structure for mounting the above-described gasket 10 to the door. As illustrated in the drawing, the engagement groove 22, into which the engagement projection 16 of the gasket 10 is inserted, is formed on the door liner 20. The engagement groove 22 is bilaterally symmetrically formed on the door liner 20. The engagement groove 22 has a relatively narrow entrance throat so as to prevent the inserted engagement projection 16 from being undesirably removed out of the engagement groove 22. Accordingly, two laterally projected portions 21*a* and 21*b* are formed in the entrance portion of the engagement groove 22. The anchor portion 16*a* of the engagement projection 16 is brought into contact with the laterally projected portions 21*a* and 21*b* when the engagement projection 16 is inserted into the engagement groove 22 of the door liner 20, thereby preventing the gasket 10 from being removed out of the engagement groove 22.

However, the conventional gasket mounting structure causes a shortcoming in which the door liner 20 becomes complicated in construction. In other words, since the two laterally projected portions 21*a* and 21*b* are bilaterally symmetrically formed on both sides of the engagement groove 22, the door liner 20 may be inferiorly formed.

The door liner 20 is fabricated in such a way that synthetic resin in the form of a plate is sucked into a mold by means of vacuum while pressure is exerted on the synthetic resin. In such a case, it is difficult to form the laterally projected portions 21*a* and 21*b* properly.

SUMMARY OF THE INVENTION

Accordingly, the present invention has been made keeping in mind the above problems occurring in the prior art, and an object of the present invention is to provide a gasket mounting structure for a refrigerator that allows the door liner of the refrigerator to be easily formed.

Another object of the present invention is to provide a gasket mounting structure for a refrigerator that facilitates the insertion of the door gasket into the mounting structure.

In order to accomplish the above object, the present invention provides a door gasket mounting structure for a refrigerator, comprising: an engagement groove for accommodating the engagement portion of a door gasket, the engagement groove being formed along the peripheral portion of a door liner; and a laterally projected portion for holding the engagement portion of the door gasket while the door gasket has been inserted into the engagement groove, the laterally projected portion being formed on one of either side of an entrance portion of the engagement groove.

In accordance with another aspect of the present invention, the laterally projected portion comprises a plurality of laterally projected portion parts, the laterally projected portion parts being alternately formed on both sides of the entrance portion of the engagement groove.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
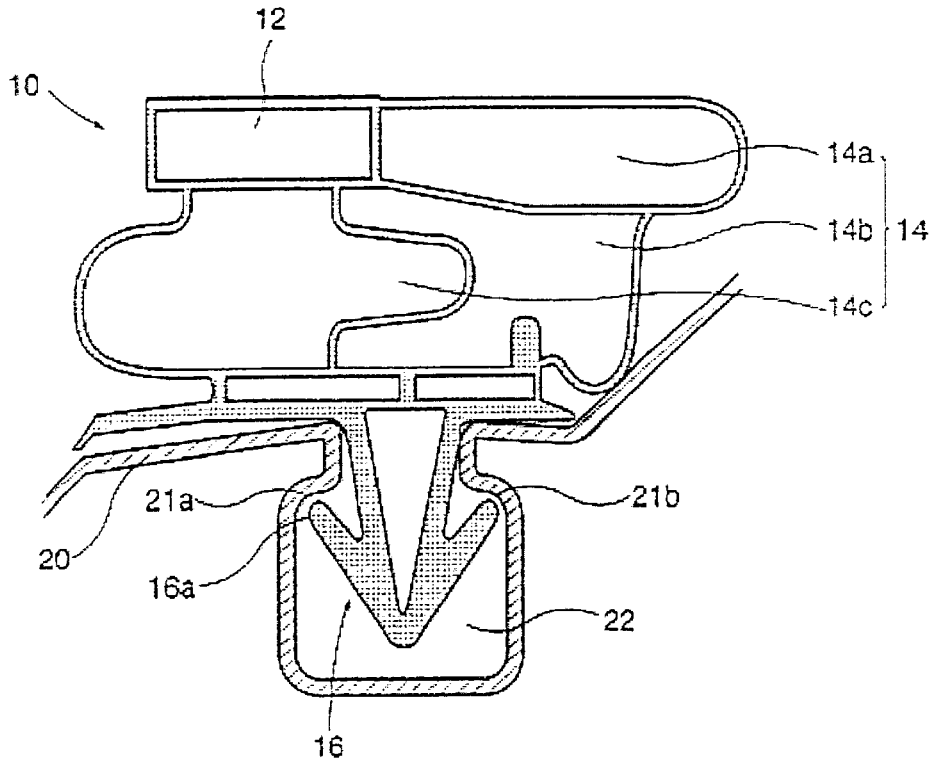
Fig 1 Prior Art
FIG. 1 is a cross section showing a state where a general gasket is mounted to a conventional door gasket mounting structure formed on the inside surface of a refrigerator door.

Reference now should be made to the drawings, in which the same reference numerals are used throughout the different drawings to designate the same or similar components.

Figure 2:
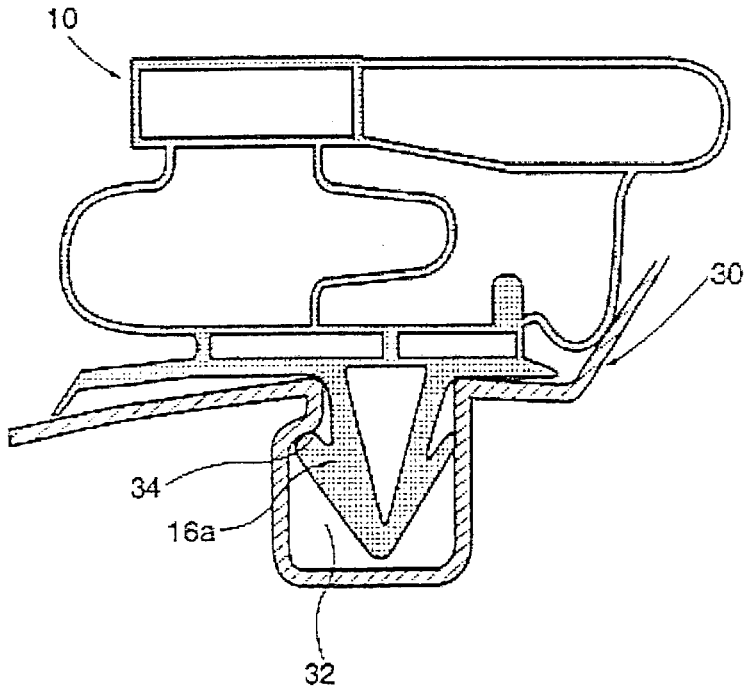
FIG. 2 is a cross section showing a state where a general gasket is mounted to a door gasket mounting structure of the present invention formed on the inside surface of a refrigerator door.

FIG. 2 is a cross section showing a state where a general gasket is mounted to a door gasket mounting structure of the present invention formed on the inside surface of a refrigerator door. As illustrated in the drawing, an engagement groove 32, into which the engagement projection 16 of a gasket 10 is inserted, is formed on a door liner 30. The engagement groove 32 functions to accommodate the engagement projection 16 of a gasket 10.

A laterally projected portion 34 is formed on one side of the entrance portion of the engagement groove 32. The laterally projected portion 34 serves to prevent the gasket 10 from being removed by holding the anchor portion 16*a* of the gasket 10 in the engagement groove 32 while the gasket 10 has been inserted into the engagement groove 32 of the door liner 30. Another laterally projected portion is not formed on the other side of the entrance portion of the engagement groove 32 that is opposed to the laterally projected portion 34, so that the other side of the entrance portion of the engagement groove 32 forms a vertical flat plane.

As described above, the laterally projected portion 34 is formed on one side of the entrance portion of the engagement groove 32, whereas an additional laterally projected portion is not formed on the other side of the entrance portion of the engagement groove 32. As a consequence, the construction of the engagement groove 32 is simplified in comparison with the construction of a conventional engagement groove 32. This implies that the door liner 30 on which the engagement groove 32 is formed can be easily fabricated and the number of inferiorly formed door liners can be reduced.

In addition, since the laterally projected portion 34 is formed on only one of either side of the entrance portion of the engagement groove 32, the space between both sides of the entrance portion of the engagement groove 32 is widened, thereby allowing the gasket to be easily inserted into the gasket mounting structure.

Figure 3:
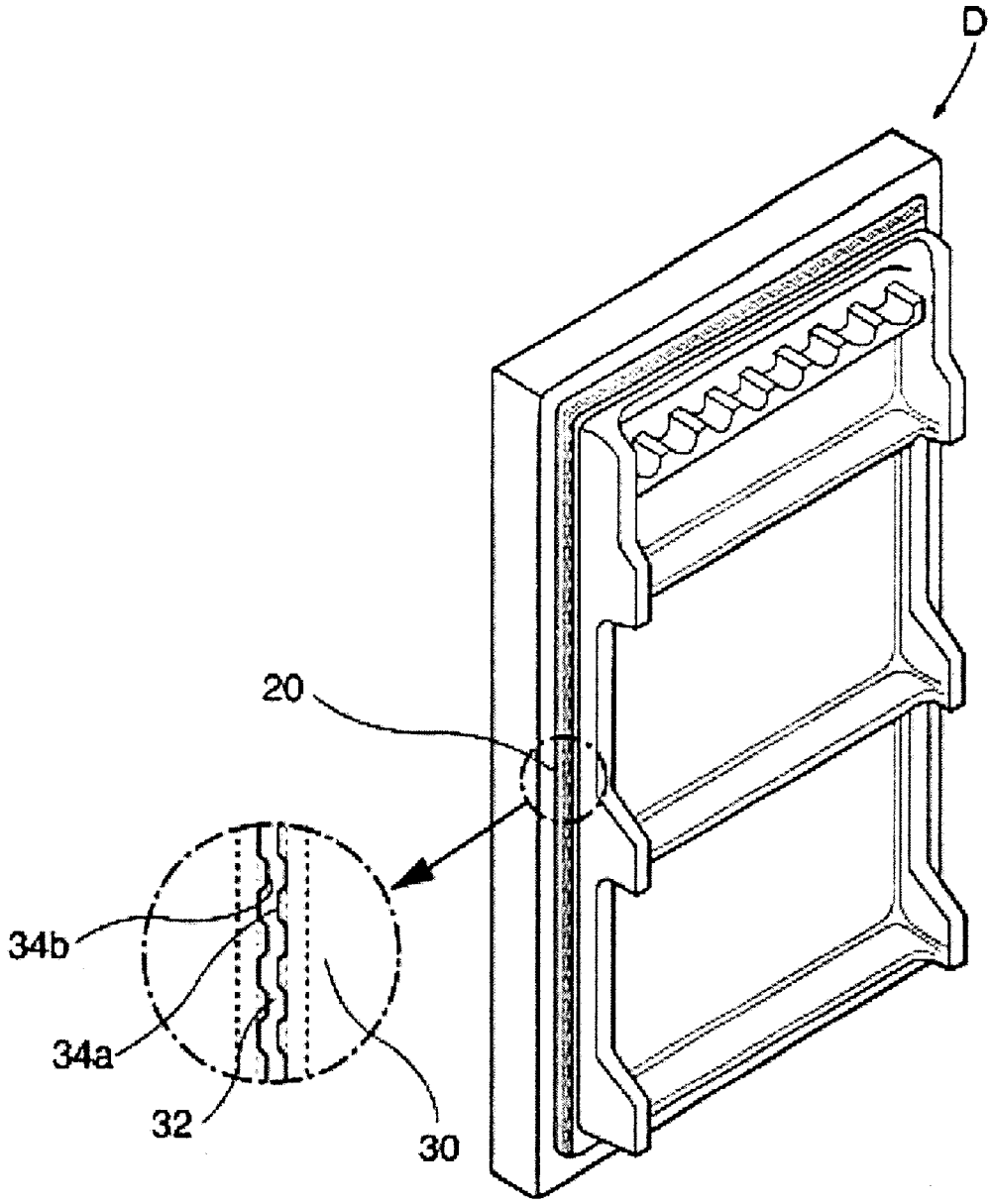
FIG. 3 is a perspective view showing the inner side of a refrigerator door.

FIG. 3 is a perspective view showing the inner side of a refrigerator door. As depicted in the drawing, the laterally projected portions 34*a* and 34*b* may be alternately formed on both sides of the entrance portion of the engagement groove 32. The reason why the laterally projected portions 34*a* and 34*b* are alternately formed on both sides of the entrance portion of the engagement groove 32 is that the gasket 10 is rendered to be securely held in the engagement groove 32 by means of the laterally projected portions 34*a* and 34*b* that are alternately formed, in consideration of a fact that one of the laterally projected portions 34*a* and 34*b* must be formed on only one of either side of the entrance portion of the engagement groove 32 in accordance with the present invention.

As a result, as can be known from FIG. 3, the left laterally projected portion 34*b* is formed on the left side of the entrance portion of the engagement groove 32 at a position spaced vertically apart by a-predetermined distance from the right laterally projected portion 34*a* formed on the right side of the entrance portion of the engagement groove 32, and another right laterally projected portion 34*a* is formed on the right side of the entrance portion of the engagement groove 32 at a position spaced vertically apart by a predetermined distance from the left laterally projected portion 34*b* formed on the left side of the entrance portion of the engagement groove 32.

The process for mounting the gasket 10 into the groove 32 is performed by inserting the engagement projection 16 into the engagement groove 32 of the door liner 30. When the gasket 10 is inserted into the engagement groove 32, one side of the anchor portion 16*a* of the engagement projection 16 is held by the laterally projected portion 34.

In accordance with the present invention, when the engagement projection 16 of the gasket 10 is inserted into the engagement groove 32 of the door liner 30 for mounting the door gasket 10 into the door, one side of the anchor portion 16*a* of the engagement projection 16 is brought into contact with the laterally projected portion 34 and the other side of the anchor portion 16*a* of the engagement projection 16 is brought into contact with the flat plane of the entrance portion of the engagement groove 32, thereby allowing the gasket 10 to be held by the laterally projected portion 34 securely.

In addition, if the laterally projected portions 34*a* and 34*b* are alternately formed on both sides of the entrance portion of the engagement groove 32, the gasket 10 is rendered to be more securely held within the engagement groove 32 by the laterally projected portions 34*a* and 34*b* that are alternately formed.

The present invention is based on a concept in which a laterally projected portion is formed on only one of either side of the entrance portion of the engagement groove.

As described above, in accordance with the present invention, the following advantages are expected.

That is, since the entire construction of a door gasket mounting structure of the present invention is simplified considerably in comparison with the conventional door gasket mounting structure, the door liner, on which the door gasket mounting structure of the present invention is formed, can be easily fabricated. Accordingly, the number of the defective door liners is reduced, so that the productivity in fabricating the door liners is improved considerably.

In addition, since a laterally projected portion is formed on only one of either side of the entrance portion of the engagement groove, interference between the engagement projection of a gasket and the laterally projected portion of the door liner is minimized when the engagement projection is inserted into the engagement groove, thereby allowing a gasket to be easily mounted to the door liner. On the other hand, after the engagement projection has been inserted into the engagement groove, the anchor portion of the engagement projection is brought into secure contact with the entrance portion of the engagement groove, thereby preventing the door gasket from being removed from the engagement groove of the door liner. Furthermore, when laterally projected portions are alternately formed on both sides of the entrance portion of the engagement groove, the anchor portion of the engagement projection is more securely held within the engagement groove of the door liner.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A door gasket mounting structure for a refrigerator, comprising:

an engagement groove for accommodating an engagement portion of a door gasket, said engagement groove being formed along a peripheral portion of a door liner; and a laterally projected portion for holding the engagement portion of the door gasket while the door gasket has been inserted into the engagement groove, wherein said laterally projected portion comprises a plurality of laterally projected portion parts and wherein the laterally projected portion parts are formed on alternating sides of the entrance portion of the engagement groove.

2. A door gasket mounting structure for a refrigerator, comprising:

an engagement groove for accommodating an engagement portion of a door gasket, said engagement groove being formed along a peripheral portion of a door liner; and a laterally projected portion for holding the engagement portion of the door gasket while the door gasket has been inserted into the engagement groove, said laterally projected portion being formed on one of either side of an entrance portion of the engagement groove and wherein said laterally projected portion comprises a plurality of laterally projected portion parts, the laterally projected portion parts being alternately formed on both sides of the entrance portion of the engagement groove.

3. A refrigerator having a housing and a door wherein an improvement comprises:

a door gasket mounting structure comprising:

an engagement groove configured to accommodate an engagement portion of a door gasket, said engagement groove being formed along a peripheral portion of a door liner; and a laterally projected portion configured to hold the engagement portion of the door gasket while the door gasket is inserted into the engagement groove, wherein said laterally projected portion comprises a plurality of laterally projected portion parts and wherein the plurality of the laterally projected portion parts are formed on alternating sides of an entrance portion of the engagement groove.

* * * * *